US011805854B2

(12) United States Patent
Bock

(10) Patent No.: US 11,805,854 B2
(45) **Date of Patent: *Nov. 7, 2023**

(54) METHOD FOR FASTENING A SHOE, IN PARTICULAR, A SPORTS SHOE, AND SHOE, IN PARTICULAR SPORTS SHOE

(71) Applicant: PUMA SE, Herzogenaurach (DE)

(72) Inventor: Markus Bock, Herzogenaurach (DE)

(73) Assignee: PUMA SE, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/462,039

(22) PCT Filed: Nov. 22, 2016

(86) PCT No.: PCT/EP2016/001968

§ 371 (c)(1),
(2) Date: May 17, 2019

(87) PCT Pub. No.: WO2018/095501

PCT Pub. Date: May 31, 2018

(65) Prior Publication Data

US 2019/0328085 A1 Oct. 31, 2019

(51) Int. Cl.
*A43C 11/00* (2006.01)
*A43B 3/36* (2022.01)
(Continued)

(52) U.S. Cl.
CPC ..... *A43C 11/008* (2013.01); *A43B 3/34* (2022.01); *A43B 3/36* (2022.01); *A43B 3/44* (2022.01);
(Continued)

(58) Field of Classification Search
CPC ..... A43B 3/0005; A43B 3/001; A43B 11/00; A43C 7/08; A43C 11/008; A43C 11/165
See application file for complete search history.

(56) References Cited

U.S. PATENT DOCUMENTS 4,442,613 A 4/1984 Dobbin
4,724,626 A 2/1988 Baggio
(Continued)

FOREIGN PATENT DOCUMENTS

CA 2500150 A1 9/2006
CN 2540805 Y 3/2003
(Continued)

OTHER PUBLICATIONS

First Office Action from corresponding Chinese Patent Application No. 201680091016.5, dated Oct. 22, 2020 (15 pages).
(Continued)

*Primary Examiner* — Sharon M Prange
(74) *Attorney, Agent, or Firm* — Quarles & Brady LLP

(57) ABSTRACT

The invention relates to a method for fastening a shoe (1), having an upper part (2) and a sole (3) connected thereto, a rotary closure (4) for fastening the shoe (1) on the wearer's foot by means of at least one tensioning element (5), the rotary closure (4) having a rotatably arranged tensioning roller (6), and the tensioning roller (6) being driven by means of an electric motor (7), and a switching element (8), which is connected to control means (9), wherein the switching element (8) and the control means (9) can actuate the electric motor (7), wherein the operation of fastening the shoe (1) takes place by virtue of the person using the shoe (1) using a finger (15) to actuate the switching element (8). In order for it to be possible for the shoe to be fastened on the wearer's foot in a particularly straightforward and reproducible manner, the invention provides for the switching element (8) to have a number of touch-sensitive sensors (10) which are arranged one beside the other and form a surface (11) which is accessible to a user's finger (15), wherein the method comprises the following steps: The finger (15) is passed over the surface (11) of the touch-sensitive sensors (10) in a first direction (R1), the control means (9) detects the signal from the touch-sensitive sensors (10) and the
(Continued)

Figure 1:
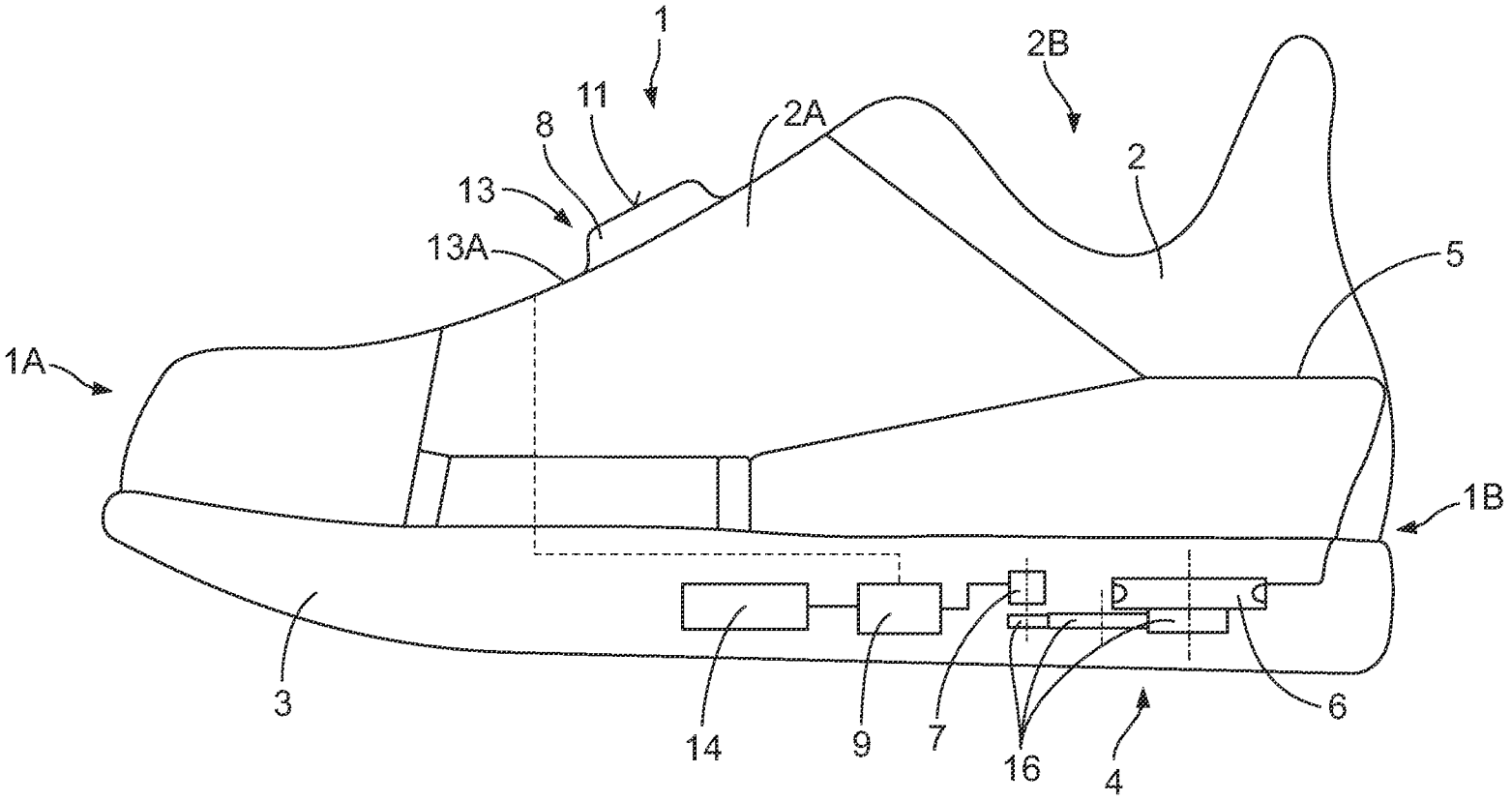

control means (9) and the electric motor (7) cause the shoe to be fastened on the wearer's foot with a first level of fastening force. The invention also relates to a shoe.

19 Claims, 2 Drawing Sheets

(51) Int. Cl.

| | |
|---|---|
| ***A43B 3/44*** | (2022.01) |
| ***A43B 5/00*** | (2022.01) |
| ***A43C 11/16*** | (2006.01) |
| ***A43B 11/00*** | (2006.01) |
| ***A43C 7/08*** | (2006.01) |
| ***A43B 3/34*** | (2022.01) |

(52) U.S. Cl.
CPC ..... *A43B 5/00* (2013.01); *A43B 11/00* (2013.01); *A43C 7/08* (2013.01); *A43C 11/165* (2013.01)

(56) References Cited

U.S. PATENT DOCUMENTS 4,741,115 A 5/1988 Pozzobon
4,748,726 A 6/1988 Schoch
4,787,124 A 11/1988 Pozzobon et al.
4,922,634 A 5/1990 Seidel
4,961,544 A 10/1990 Bidoia
5,051,095 A 9/1991 Slenker
5,206,804 A 4/1993 Thies et al.
5,325,613 A 7/1994 Sussmann
5,724,265 A 3/1998 Hutchings
5,839,210 A 11/1998 Bernier et al.
5,955,667 A 9/1999 Fyfe
5,983,530 A 11/1999 Chou
6,018,705 A 1/2000 Gaudet et al.
6,032,387 A 3/2000 Johnson
6,052,654 A 4/2000 Gaudet et al.
6,202,953 B1 3/2001 Hammerslag
6,289,558 B1 9/2001 Hammerslag
6,427,361 B1 8/2002 Chou
6,430,843 B1 8/2002 Potter et al.
6,691,433 B2 2/2004 Liu
6,865,825 B2 3/2005 Bailey, Sr. et al.
6,876,947 B1 4/2005 Darley et al.
6,882,955 B1 4/2005 Ohlenbusch et al.
6,892,477 B2 5/2005 Potter et al.
6,978,684 B2 12/2005 Nurse
7,082,701 B2 8/2006 Dalgaard et al.
7,096,559 B2 8/2006 Johnson
7,188,439 B2 3/2007 DiBenedetto et al.
7,310,895 B2 12/2007 Whittlesey et al.
7,503,131 B2 3/2009 Nadel et al.
7,607,243 B2 10/2009 Berner, Jr. et al.
7,721,468 B1 5/2010 Johnson et al.
7,752,774 B2 * 7/2010 Ussher ..... A43C 11/165 36/50.1
7,794,101 B2 9/2010 Galica et al.
D648,110 S 11/2011 Rasmussen
8,046,937 B2 11/2011 Beers et al.
8,056,269 B2 11/2011 Beers et al.
8,058,837 B2 11/2011 Beers et al.
8,061,061 B1 11/2011 Rivas
8,074,379 B2 12/2011 Robinson, Jr. et al.
8,277,401 B2 10/2012 Hammerslag et al.
8,387,282 B2 3/2013 Baker et al.
8,424,168 B2 4/2013 Soderberg et al.
8,468,657 B2 6/2013 Soderberg et al.
8,474,146 B2 7/2013 Hartford et al.
8,516,662 B2 8/2013 Goodman et al.
D689,684 S 9/2013 McMillan
8,522,456 B2 9/2013 Beers et al.
8,528,235 B2 9/2013 Beers et al.
8,676,541 B2 3/2014 Schrock et al.
8,678,541 B2 3/2014 Uchiyama
8,713,820 B2 5/2014 Kerns et al.
8,739,639 B2 6/2014 Owings et al.
8,769,844 B2 7/2014 Beers et al.
D718,036 S 11/2014 McMillan
8,904,672 B1 12/2014 Johnson
8,904,673 B2 12/2014 Johnson et al.
8,935,860 B2 1/2015 Torres
9,072,341 B2 7/2015 Jungkind
D740,538 S 10/2015 Roulo
9,149,089 B2 10/2015 Cotterman et al.
9,204,690 B1 * 12/2015 Alt ..... A43B 11/00
D746,558 S 1/2016 Campbell et al.
9,241,539 B1 1/2016 Keswin
9,248,040 B2 2/2016 Soderberg et al.
D750,879 S 3/2016 Klein et al.
9,301,573 B2 4/2016 Jasmine
9,307,804 B2 4/2016 Beers et al.
D756,621 S 5/2016 Weddle
9,326,566 B2 5/2016 Beers et al.
9,365,387 B2 6/2016 Beers et al.
9,380,834 B2 7/2016 Rushbrook et al.
D768,977 S 10/2016 Seamarks et al.
9,462,844 B2 10/2016 Schrock et al.
9,532,893 B2 1/2017 Beers et al.
9,578,926 B2 2/2017 Alt et al.
9,609,918 B2 4/2017 Beers
9,610,185 B2 4/2017 Capra et al.
9,629,418 B2 4/2017 Rushbrook et al.
9,693,605 B2 7/2017 Beers
9,706,814 B2 7/2017 Converse et al.
9,756,895 B2 9/2017 Rice et al.
9,763,489 B2 9/2017 Amos et al.
9,848,674 B2 * 12/2017 Smith ..... A43C 11/165
9,861,164 B2 1/2018 Beers et al.
9,861,165 B2 1/2018 Schneider et al.
9,867,417 B2 1/2018 Beers et al.
9,872,539 B2 1/2018 Beers
9,907,359 B2 3/2018 Beers
9,918,516 B1 3/2018 Hall
9,918,865 B2 3/2018 Nickel et al.
D814,776 S 4/2018 Odinot
D815,413 S 4/2018 Weddle
9,943,139 B2 4/2018 Beers et al.
9,961,963 B2 5/2018 Schneider et al.
9,993,046 B2 6/2018 Bock
10,004,295 B2 6/2018 Gerber
10,010,129 B2 7/2018 Beers et al.
10,034,512 B2 7/2018 Rushbrook et al.
10,046,942 B2 8/2018 Beers et al.
10,070,681 B2 9/2018 Beers et al.
10,070,683 B2 9/2018 Rushbrook et al.
10,076,462 B2 9/2018 Johnson et al.
D829,425 S 10/2018 Albrecht et al.
10,085,517 B2 10/2018 Beers et al.
10,092,065 B2 10/2018 Rushbrook et al.
10,102,722 B2 10/2018 Levesque et al.
10,104,937 B2 10/2018 Beers et al.
10,111,496 B2 10/2018 Schneider et al.
10,201,212 B2 2/2019 Beers et al.
10,231,505 B2 3/2019 Beers et al.
10,238,180 B2 3/2019 Beers et al.
10,349,703 B2 7/2019 Bock
10,441,020 B1 10/2019 Andon et al.
2003/0009913 A1 1/2003 Potter et al.
2003/0150135 A1 8/2003 Liu
2004/0177531 A1 9/2004 DiBenedetto et al.
2005/0081403 A1 4/2005 Mathieu
2005/0183292 A1 8/2005 DiBenedetto et al.
2005/0198867 A1 9/2005 Labbe
2006/0000116 A1 1/2006 Brewer
2006/0103538 A1 5/2006 Daniel
2007/0000154 A1 1/2007 DiBenedetto et al.
2007/0006489 A1 1/2007 Case et al.
2007/0129907 A1 6/2007 Demon
2007/0164521 A1 7/2007 Robinson
2007/0260421 A1 11/2007 Berner et al.
2007/0271817 A1 11/2007 Ellis
2008/0066272 A1 3/2008 Hammerslag et al.

(56) References Cited

U.S. PATENT DOCUMENTS

2008/0196224 A1 8/2008 Hu
2008/0301919 A1 12/2008 Ussher
2009/0184189 A1 7/2009 Soderberg et al.
2009/0193689 A1 8/2009 Galica et al.
2009/0272007 A1 11/2009 Beers et al.
2009/0272013 A1* 11/2009 Beers ..... A43B 1/0054 36/137
2010/0063778 A1 3/2010 Schrock et al.
2010/0063779 A1 3/2010 Schrock et al.
2010/0139057 A1 6/2010 Soderberg et al.
2010/0289971 A1 11/2010 Odland et al.
2011/0025704 A1 2/2011 Odland et al.
2011/0175744 A1 7/2011 Englert et al.
2011/0225843 A1 9/2011 Kerns et al.
2011/0232134 A1 9/2011 Radl et al.
2011/0266384 A1 11/2011 Goodman et al.
2012/0000091 A1 1/2012 Cotterman et al.
2012/0004587 A1 1/2012 Nickel et al.
2012/0124500 A1 5/2012 Hunter
2012/0185801 A1 7/2012 Madonna et al.
2013/0092780 A1 4/2013 Soderberg et al.
2013/0104429 A1* 5/2013 Torres ..... A43C 11/008 36/136
2013/0213147 A1 8/2013 Rice et al.
2013/0312293 A1 11/2013 Gerber
2014/0068838 A1 3/2014 Beers et al.
2014/0070042 A1* 3/2014 Beers ..... A43B 3/0015 242/413
2014/0082963 A1 3/2014 Beers
2014/0257156 A1 9/2014 Capra et al.
2014/0292396 A1* 10/2014 Bruwer ..... H03K 17/962 327/517
2015/0007422 A1 1/2015 Cavanagh et al.
2015/0185764 A1 7/2015 Magi
2015/0250268 A1* 9/2015 Alt ..... A43C 11/165 24/68 SK
2015/0289594 A1 10/2015 Rushbrook
2016/0027297 A1 1/2016 Wu et al.
2016/0157561 A1 6/2016 Schum et al.
2016/0256349 A1 9/2016 Mayer et al.
2016/0262485 A1 9/2016 Walker
2016/0345654 A1 12/2016 Beers et al.
2016/0345679 A1 12/2016 Beers et al.
2016/0345681 A1* 12/2016 Pheil ..... A43B 11/00
2016/0360828 A1 12/2016 Guyan
2017/0035151 A1 2/2017 Peyton et al.
2017/0150773 A1 6/2017 Beers
2017/0215524 A1 8/2017 Rushbrook et al.
2017/0265559 A1 9/2017 Beers
2017/0265572 A1 9/2017 Beers et al.
2017/0265573 A1 9/2017 Beers et al.
2017/0265574 A1 9/2017 Beers et al.
2017/0265575 A1 9/2017 Beers et al.
2017/0265576 A1 9/2017 Beers et al.
2017/0265577 A1 9/2017 Schneider
2017/0265578 A1 9/2017 Schneider
2017/0265579 A1 9/2017 Schneider et al.
2017/0265580 A1 9/2017 Schneider et al.
2017/0265581 A1 9/2017 Chang
2017/0265582 A1 9/2017 Walker et al.
2017/0265583 A1 9/2017 Schneider et al.
2017/0265584 A1 9/2017 Walker et al.
2017/0265585 A1 9/2017 Orand
2017/0265586 A1 9/2017 Schneider et al.
2017/0265587 A1 9/2017 Walker et al.
2017/0265588 A1 9/2017 Walker et al.
2017/0265589 A1 9/2017 Walker et al.
2017/0265591 A1 9/2017 Schneider
2017/0265594 A1 9/2017 Walker et al.
2017/0267485 A1 9/2017 Schneider et al.
2017/0272008 A1 9/2017 Schneider
2017/0295889 A1 10/2017 Beers
2017/0303643 A1 10/2017 Converse et al.
2017/0312161 A1 11/2017 Johnson et al.
2017/0318908 A1 11/2017 Wyatt et al.
2017/0332734 A1 11/2017 Orand
2017/0332735 A1 11/2017 Orand et al.
2017/0340049 A1 11/2017 Rice et al.
2018/0020764 A1 1/2018 Walker
2018/0035760 A1 2/2018 Bock
2018/0110288 A1 4/2018 Hatfield et al.
2018/0110294 A1 4/2018 Schneider et al.
2018/0110298 A1 4/2018 Schneider et al.
2018/0116326 A1 5/2018 Beers et al.
2018/0125168 A1* 5/2018 Beers ..... A43B 3/0005
2018/0153260 A1 6/2018 Beers
2018/0153263 A1 6/2018 Beers et al.
2018/0199674 A1 7/2018 Walker et al.
2018/0219403 A1 8/2018 Schneider
2018/0228250 A1 8/2018 Beers et al.
2018/0263340 A1 9/2018 Schneider et al.
2018/0289110 A1 10/2018 Bock et al.
2018/0310644 A1 11/2018 Poupyrev et al.
2018/0310659 A1 11/2018 Poupyrev et al.
2018/0310670 A1 11/2018 Rovekamp, Jr. et al.
2018/0317609 A1 11/2018 Beers et al.
2018/0342978 A1 11/2018 Joardar
2018/0343977 A1 12/2018 Riccomini et al.
2018/0368526 A1 12/2018 Bock et al.
2018/0368528 A1 12/2018 Beers et al.
2019/0246745 A1 8/2019 Bock et al.
2019/0246746 A1 8/2019 Bock et al.
2019/0246747 A1 8/2019 Bock et al.
2019/0328085 A1 10/2019 Bock
2021/0235819 A1 8/2021 Andreasen

FOREIGN PATENT DOCUMENTS

CN 201222723 Y 4/2009
CN 102058197 A 5/2011
CN 202907266 U 4/2013
CN 104585975 A 5/2015
CN 104822284 A 8/2015
CN 105278768 A 1/2016
DE 29701491 U1 5/1998
DE 29817003 U1 3/1999
DE 19833801 A1 2/2000
DE 102005014709 A1 10/2006
DE 102005036013 A1 2/2007
DE 102005052903 A1 5/2007
EP 0614624 A1 9/1994
EP 2871994 A1 5/2015
EP 3046434 A1 7/2016
FR 2770379 A1 5/1999
FR 2924577 A1 6/2009
GB 2449722 A 12/2008
JP 3005659 U 1/1995
JP 3195320 B2 8/2001
JP 2004267784 A 9/2004
JP 2004275201 A 10/2004
JP 2009011460 A 1/2009
JP 2011519611 A 7/2011
JP 5486203 B2 5/2014
JP 2016530058 A 9/2016
JP 2018529479 A 10/2018
KR 100398822 B1 9/2003
KR 1020050122149 A 12/2005
WO 1998011797 A1 3/1998
WO 2008033963 A2 3/2008
WO 2009134858 A1 11/2009
WO 2012109244 A1 8/2012
WO 2014036374 A1 3/2014
WO 2014082652 A1 6/2014
WO 2015014374 A1 2/2015
WO 2015042216 A1 3/2015
WO 2015045598 A1 4/2015
WO 2015056633 A1 4/2015
WO 2015160406 A1 10/2015
WO 2015160768 A1 10/2015
WO 2015160790 A1 10/2015
WO 2015163982 A1 10/2015
WO 2016057697 A1 4/2016
WO 2016191115 A1 12/2016

(56) References Cited

FOREIGN PATENT DOCUMENTS

| | | | |
|---|---|---|---|
| WO | 2016191117 | A1 | 12/2016 |
| WO | 2016191123 | A1 | 12/2016 |
| WO | 2016195957 | A1 | 12/2016 |
| WO | 2016195965 | A1 | 12/2016 |
| WO | 2017059876 | A1 | 4/2017 |
| WO | 2017091769 | A1 | 6/2017 |
| WO | 2017092775 | A1 | 6/2017 |
| WO | 2017095945 | A1 | 6/2017 |
| WO | 2017158410 | A1 | 9/2017 |
| WO | 2017160534 | A2 | 9/2017 |
| WO | 2017160536 | A2 | 9/2017 |
| WO | 2017160558 | A2 | 9/2017 |
| WO | 2017160561 | A2 | 9/2017 |
| WO | 2017160563 | A2 | 9/2017 |
| WO | 2017160657 | A2 | 9/2017 |
| WO | 2017160708 | A2 | 9/2017 |
| WO | 2017160865 | A1 | 9/2017 |
| WO | 2017160866 | A1 | 9/2017 |
| WO | 2017160881 | A1 | 9/2017 |
| WO | 2017160969 | A1 | 9/2017 |
| WO | 2017161000 | A2 | 9/2017 |
| WO | 2017161014 | A1 | 9/2017 |
| WO | 2017161037 | A1 | 9/2017 |
| WO | 2017161044 | A1 | 9/2017 |
| WO | 2017164612 | A1 | 9/2017 |
| WO | 2017185160 | A1 | 11/2017 |
| WO | 2017189926 | A1 | 11/2017 |
| WO | 2017197627 | A1 | 11/2017 |
| WO | 2017091769 | A8 | 1/2018 |
| WO | 2018028380 | A1 | 2/2018 |
| WO | 2018028381 | A1 | 2/2018 |
| WO | 2018081260 | A1 | 5/2018 |
| WO | 2018094156 | A1 | 5/2018 |
| WO | 2018095500 | A1 | 5/2018 |
| WO | 2018095501 | A1 | 5/2018 |
| WO | 2018095507 | A1 | 5/2018 |
| WO | 2018120085 | A1 | 7/2018 |
| WO | 2017161000 | A3 | 8/2018 |
| WO | 2018170148 | A2 | 9/2018 |
| WO | 2018170148 | A3 | 11/2018 |
| WO | 2018222805 | A2 | 12/2018 |
| WO | 2018222807 | A2 | 12/2018 |
| WO | 2018222836 | A2 | 12/2018 |

OTHER PUBLICATIONS

Japanese Office Action from corresponding Japanese Patent Application No. 2019-525884, dated Aug. 25, 2020 (English translation included) (8 pages).

Invitation to Pay Additional Fees and Communication Relating to Results of Partial International Search Report from corresponding PCT Application No. PCT/IB2020/058424 dated Dec. 8, 2020 (12 pages).

International Search Report of International Application No. PCT/EP2016/001968, dated Jul. 31, 2017, 6 pages.

Written Opinion of International Application No. PCT/EP2016/001968, dated Jul. 31, 2017, 6 pages.

International Preliminary Report on Patentability (Form IPEA/409) of International Application No. PCT/EP2016/001968, dated Jan. 9, 2019, 31 pages.

The First Office Action issued in corresponding Chinese Application No. 201580084987.2, dated May 6, 2020, 25 pages.

Notice of Reasons for Refusal issued in Japanese Application No. 2018-524270, dated Dec. 3, 2019, 9 pages.

Search Report by Registered Search Organization issued in Japanese Application No. 2018-524270, dated Nov. 27, 2019, 128 pages.

International Search Report and Written Opinion of International Application No. PCT/IB2020/053777, dated Jun. 18, 2020, 12 pages.

International Search Report and Written Opinion of International Application No. PCT/IB2020/053778, dated Jun. 18, 2020, 14 pages.

The First Office Action issued in corresponding Chinese Application No. 201680091000.4, dated Jun. 5, 2020, 19 pages.

International Search Report of International Application No. PCT/EP2016/001967, dated Jul. 26, 2017, 7 pages.

Written Opinion of International Application No. PCT/EP2016/001967, dated Jul. 26, 2017, 6 pages.

International Preliminary Report on Patentability (Form IPEA/409) of International Application No. PCT/EP2016/001967, dated Jan. 4, 2019, 23 pages.

Andrew Liszewski: "A Self-Adjusting Smart Bell: Yes, It's Come to This", Jan. 4, 2015 (Jan. 4, 2015), Retrieved from the Internet: URL: https://gixmodo.com/the-only-gdget-the-world-really-needs-is-a-self-adjust-1677432880 [retrieved on May 16, 2019], 3 pages.

International Search Report of International Application No. PCT/EP2015/001963, dated Aug. 9, 2016, 5 pages.

Extended European Search Report of European Patent Application 20721799.3 dated Aug. 4, 2022 (8 pages).

Office Action from corresponding Japanese Application No. 2021-562055 dated Mar. 26, 2023 (9 pages) with English translation.

Preliminary Rejection issued in Korean Application No. KR10-2021-7036605 dated Jul. 11, 2023 (13 pages).

Preliminary Rejection issued in Korean Application No. KR10-2021-7036607 dated Jul. 11, 2023 (13 pages).

Preliminary Rejection issued in Korean Application No. KR10-2021-7036585 dated Jul. 11, 2023 (17 pages).

* cited by examiner

METHOD FOR FASTENING A SHOE, IN PARTICULAR, A SPORTS SHOE, AND SHOE, IN PARTICULAR SPORTS SHOE

This application is a U.S. National Stage application, filed pursuant to 35 U.S.C. § 371, of international application no. PCT/EP2016/001968, filed on Nov. 22, 2016, the contents of which is incorporated herein by reference in its entirety.

The invention relates to a method for fastening a shoe, in particular a sports shoe, wherein the shoe comprises:

an upper part and a sole which is connected with the upper part, a rotary closure for fastening the shoe on the wearer's foot by means of at least one tensioning element, wherein the rotary closure comprises a rotatably arranged tensioning roller for winding the tensioning element, wherein the tensioning roller being driven by means of an electric motor, a switching element which is connected to control means, wherein the switching element and the control means can actuate the electric motor, wherein the operation of fastening the shoe takes place by actuating of the switching element by the user of the shoe, preferably using a finger.

Furthermore, the invention relates to a shoe, in particular to a sports shoe.

A shoe with an electric motor driven rotary closure is known from DE 298 17 003 U1. Here, a tension roller for winding up a tension element is driven by an electric motor so that the shoe can be laced and unlaced automatically.

To tie the shoe, the user operates an electric switch and activates the electric motor of the rotary closure as long as the switch is pressed. The lacing force gradually increases accordingly. When the desired lacing force level is reached, the user releases the switch. Another switch can be used to release the lacing force.

Therefore, the lacing of the shoe requires an appropriate time during which the user must press the switch. In addition, the user must set the desired lacing force level for each lacing.

It is the object of the invention to further develop a method of the type mentioned above in such a way that lacing the shoe can be done more comfortably and in a simplified manner. In particular, it should be possible to adapt the lacing of the shoe to individual wishes in a user-friendly way. This should make it possible to put on the shoe with a defined lacing force level according to the user's wishes without a great operating effort. Furthermore, an appropriate shoe should be made available.

The solution of the object by the invention is characterized in that the switching element comprises a number of touch-sensitive sensors which are arranged one beside the other and form a surface which is accessible to a user (especially for a finger of the user), wherein the method comprises the steps:

Passing over the surface of the touch-sensitive sensors by the user, preferably with the finger, in a first direction, Detecting of the signal of the touch-sensitive sensors by the control means and causing of the fastening of the shoe at the foot of the wearer at a first level of fastening force by the control means and the electric motor.

The method can furthermore comprise the steps:

Newly passing over the surface of the touch-sensitive sensors by the user, preferably with the finger, in the first direction, Detecting of the signal of the touch-sensitive sensors by the control means and causing of the fastening of the shoe at the foot of the wearer at a second level of fastening force which is higher than the first level of fastening force by the control means and the electric motor.

Thus a second, higher lacing force level can be easily reached. This principle can also be continued: The method can also include the steps:

Newly passing over the surface of the touch-sensitive sensors by the user, preferably with the finger, in the first direction, Detecting of the signal of the touch-sensitive sensors by the control means and causing of the fastening of the shoe at the foot of the wearer at a third level of fastening force which is higher than the second level of fastening force by the control means and the electric motor.

Further passings of the touch-sensitive sensors can also be carried out to further increase the lacing force level step by step. A lacing force level is preferably defined by the current with which the electric motor is operated (see below).

The opening of the shoe or the reduction of the lacing force level is preferred by carrying out the following steps:

Passing over the surface of the touch-sensitive sensors by the user, preferably with the finger, in a second direction which is opposite to the first direction, Detecting of the signal of the touch-sensitive sensors by the control means and causing of the opening of the shoe or of a reduction of the level of the fastening force by the control means and the electric motor.

For the fully de-laced end position, the tensioning roller can be equipped with a rotation angle sensor which is able to detect the zero position of the tensioning roller.

The above-mentioned passing of the surface of the touch-sensitive sensors is done according to a preferred procedure in such a way that the user (preferably using a finger) completely passes over the sensors, i.e. over the entire surface area of the sensors. In this way—as described—the lacing force level can be increased step by step or in steps; in the same way the lacing force level can be reduced or the shoe completely opened (if the surface is passed in the opposite direction).

However, it is also possible not to pass the surface of the touch-sensitive sensors completely, but only over a part of their extension (with the finger). Depending on the length over which the user has passed the surface, the controller can then send a (preferably proportional) signal to the electric motor so that the tension of the lacing is increased accordingly or reduced (by passing in the opposite direction).

Thus, the proposed procedure allows a stepwise closing (lacing) and opening (re-lacing) of the shoe, for which the surface of the touch-sensitive sensors is completely or only partially passed over in order to be able to finely adjust said lacing or opening.

This makes it possible, by simply passing over the number of touch-sensitive sensors (in the first direction), to approach specifically defined lacing force levels of the shoe and also to open the shoe, i.e. release the tension element, by passing over the sensors once (in the second direction).

This makes lacing and unlacing very easy and comfortable.

At or on the switching element a number of illumination elements, especially in the form of Light-Emitting Diodes (LED), can be arranged, wherein the actual level of the fastening force is displayed by the number of activated illumination elements. This allows the user of the shoe to easily see how tightly the shoe is currently laced on the foot.

The more LEDs light up, the more the shoe is tightened. The open state of the shoe can also be indicated by the LEDs.

The proposed shoe with rotary closure and switching element is characterized by the invention in that the switching element is formed by a number of touch-sensitive sensors which are arranged one beside the other which form a surface which is accessible to a user (especially for a finger of the user). The common surface of the sensors is as smooth and even as possible.

This is to be understood in such a way that the individual touch-sensitive sensors can be activated by passing over the surface in order to generate the above-mentioned functionality.

The single touch-sensitive sensors are thereby designed preferably as capacitive sensors.

The single touch-sensitive sensors are arranged preferably side by side in a linear formation, wherein preferably between 3 and 7 touch-sensitive sensors are arranged side by side.

At or on the switching element a number of illumination elements, especially LEDs, are preferably arranged.

According to a preferred embodiment the switching element and the rotary closure are arranged at different locations of the shoe. The switching element is preferably arranged at the instep of the shoe; the rotary closure is preferably arranged in the sole of the shoe.

However, other positions are also possible for the switching element and the rotary closure. Both elements can be arranged as a unit on the instep. It is also possible to arrange the switching element in the side area of the shoe or the upper part of the shoe or in the heel area. Here, too, a combination with the rotary closure to form a unit (consisting of rotary closures and switching element) is possible.

As explained above, the user will usually pass over the surface of the touch-sensitive sensors with his finger. However, this is not mandatory; it can also be provided that an aid (e.g. a pen) is used for passing.

Spring means can be arranged in the upper part which bias the upper part against the force of the tensioning element in an open-position. This ensures that the upper part of the shoe "folds open" into an open position after the rotary closure has been opened, making it easier to put on and take off the shoe.

For the supply of energy preferably a rechargeable battery is arranged in the shoe which is rechargeable inductively and/or contactless. In this case, the battery required for the operation of the motor is therefore designed as a rechargeable battery and is supplied with a charging current via an induction coil. The battery can be arranged in a (mid) sole of the shoe. The electronics required for charging can be placed directly on the battery. By providing an induction coil, the shoe's battery can be charged without contact. The shoe can be placed on an appropriate charging plate to charge the battery. The LEDs mentioned above can also be used to indicate charging or the charging status. For example, the LEDs may flash during charging, with more and more LEDs flashing as the battery is charged more and more.

It can also be provided that the state of charge of the battery is indicated by the LEDs while the shoe is in use. For example, at a certain charge level (e.g. when the battery is less than 50% of its maximum charge level) the LEDs may start flashing.

The shoe can also comprise an interface which is designed for a wireless communication with a mobile phone, especially for the communication via Bluetooth. Thus, communication with the mobile phone (smartphone) can take place via a wireless connection and in this case the switching element can be moved into the mobile phone; in this case the switching element is formed by the mobile phone. This means that the rotary closure can be controlled wirelessly via Bluetooth using a smartphone, which is equipped with a corresponding app for this purpose.

The touch-sensitive sensors mentioned here are commercially available as such and are also referred to as "swipe sensor" or "touch panel". These are generally a number (usually between three and seven) of sensors arranged next to each other, each of which is touch-sensitive. This enables the controller to recognize which action (closing or opening) is to be carried out by means of the sequence of measured impulses from the individual sensors at passing in the first or second direction.

The first lacing force level is preferably defined by a first predetermined maximum current, which the controller sets for the electric motor during the lacing process; this current is preferably between 1.1 A and 1.9 A. The second lacing force level is defined analogously and preferably by a second predetermined maximum current which the control gives to the electric motor during the lacing operation, wherein the second maximum current being higher than the first maximum current; said current preferably being between 2.1 A and 2.9 A. The third level of lacing force is correspondingly preferably defined by a third predetermined maximum current which the controller gives to the electric motor during the lacing operation, wherein the third maximum current being higher than the second maximum current; the current is preferably between 3.1 A and 3.9 A.

These lacing force levels are thus defined by the specification of a corresponding motor current (e.g. first level: 1.5 A—second level: 2.5 A—third level: 3.5 A), so that the motor is operated with corresponding maximum torques, which in turn leads to a corresponding increasing tensile force in the tensioning element via the preferred gear between motor and tensioning roller.

Preferably a first tensioning element is arranged which runs on the lateral side of the upper part of the shoe, wherein a second tensioning element being arranged which runs on the medial side of the upper part of the shoe; both tensioning elements are fastened with their two ends to the tensioning roller and form a closed curve on the lateral side and on the medial side of the upper part of the shoe respectively.

The two curves of the two tensioning elements on the lateral side and on the medial side of the upper are preferably substantially symmetrical to a central plane of the shoe, with the central plane running vertically and in the longitudinal direction of the shoe.

A special guidance of the two tensioning elements on both sides of the shoe upper is particularly preferred in order to achieve an optimal distribution of the tensile force and thus an optimal contact of the shoe with the wearer's foot.

After this, each tensioning element can run from the tensioning roller to a first deflecting element which deflects the tensioning element in the lower part of the upper part of the shoe and at a point which lies in the range between 30% and 42% of the longitudinal extension of the shoe, calculated from the tip of the shoe.

Furthermore, each tensioning element may be provided to extend from the first deflecting element to a second deflecting element which deflects the tensioning element in the lower region of the upper part of the shoe and at a point which lies in the range between 50% and 60% of the longitudinal extent of the shoe, calculated from the tip of the shoe.

Furthermore, each tensioning element can run from the second deflecting element to a third deflecting element, wherein the tensioning element being located in the upper region of the upper part of the shoe adjacent to the rotary closure.

Each tension member may also extend from the third deflecting element to a fourth deflecting element which deflects the tensioning element in the lower portion of the uppers and at a location in the range between 55% and 70% of the length of the shoe, calculated from the tip of the shoe.

Finally, each tensioning element may be provided to extend from the fourth deflecting element to a fifth deflecting element which deflects the tensioning element in the range between 33% and 66% of the total height of the shoe and at a location which is in the range between 75% and 90% of the longitudinal extent of the shoe, calculated from the tip of the shoe, wherein the tensioning element extending from the fifth deflecting element to the tensioning roller.

The abovementioned positioning of the deflection elements in the lower region of the upper part of the shoe is to be understood in such a way that the deflection elements are fixed to the sole of the shoe or to the upper part of the shoe slightly above the sole and thus the deflection point of the tensioning element lies in a height range which lies below a mark of 20% of the vertical extent (when the shoe stands on the ground) of the upper part of the shoe.

At least one of the deflection elements can be designed as a loop which is attached to the upper part of the shoe and/or to the sole of the shoe, in particular sewn on.

The loops may consist of a band sewn to the upper part and/or sole of the shoe.

The fifth deflection element mentioned above preferably encompasses the heel area of the shoe. It is preferably intended that the fifth deflection element has a V-shaped configuration in the side view of the shoe, one leg of the V-shaped structure ending in the upper heel area and the other leg of the V-shaped structure ending in the lower heel area in the side view of the shoe.

The tensioning elements are preferably tensioning wires. They can comprise polyamide or can be made of this material.

In an advantageous way, the ease of use can be improved when using a shoe with an electromotive lacing system with a rotary closure.

The proposed method may also be further developed by placing a pressure sensor on or inside the shoe to detect the degree of lacing tension of the shoe on the wearer's foot. This pressure can be compared with a value stored in the controller. If a too high pressure is detected while wearing the shoe, it can be provided that the control automatically causes a reduction of the lacing tension. Conversely, if the pressure is too low, the shoe can also be laced again, which can be done by the control system self-sufficiently.

In the drawings an embodiment of the invention is shown.

Figure 2:
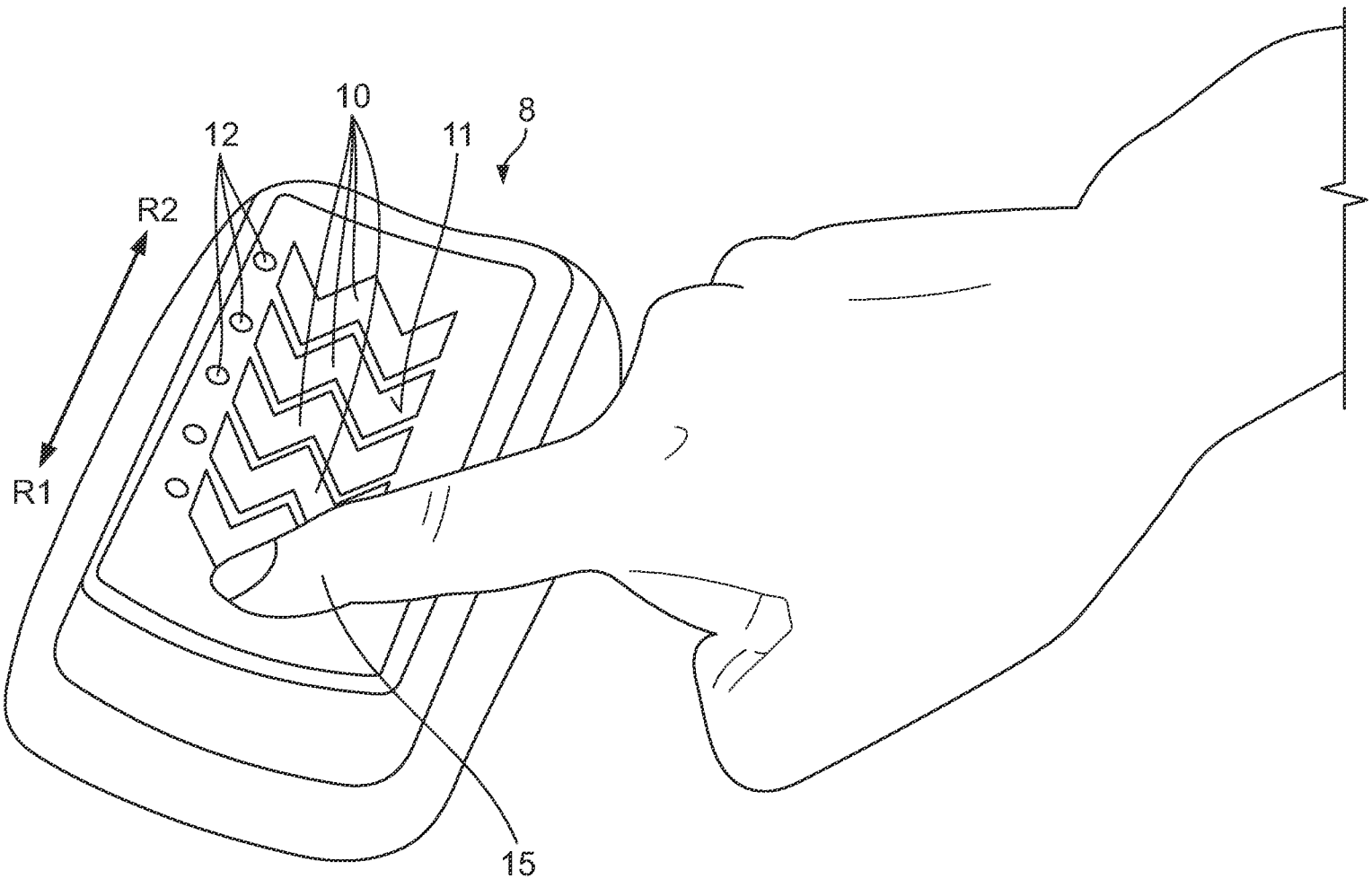

FIG. 1 shows schematically in the side view a sports shoe, depicted partially cut, which can be fastened with a rotary closure and FIG. 2 shows in perspective view a switching element for the actuation of the rotary closure by the finger of the person which uses the sports shoe.

FIG. 1 shows a shoe 1, being a sports shoe, which comprises an upper part 2 and a sole 3. The lacing of shoe 1 is carried out by means of a rotary closure 4 (i.e. a central closure), whereby by turning a tensioning roller 6 at least one tensioning element 5 is wound onto the tensioning roller 6 and so the upper part 2 is tensioned or laced at the foot of the wearer of shoe 1. The tensioning element 5 and its course are only very schematically indicated in FIG. 1. The shoe 1 includes a forefoot region 1A and a heel region 1B, and the upper 2 includes a lateral side 2A and a medial side (not shown) opposite the lateral side 2A. A heel cavity 2B is also shown, which is disposed within the heel region 1B.

The rotary closure 4 is located in the sole 3 of shoe 1. A switching element 8 for actuating the rotary closure 4 is arranged on a tongue 13A of the instep 13 of the shoe 1 at a distance from the rotary closure 4. This provides easy access to the switching element 8 for operating the rotary closure 4.

The electric motor 7 required to operate the rotary closure 4 is indicated; it drives the tensioning roller 6 via a gearing 16. The operation of the electric motor 7 to open and close the rotary closure 4 is initiated by control means 9 which are connected to the switching element 8. A battery 14 is provided for the power supply of electric motor 7 and control means 9. The switching element 8 is located at the instep 13 between the forefoot region 1A and the heel region 1B, and between the lateral side 2A and the medial side (not shown) of the upper.

To close and open shoe 1, the user proceeds as follows:

As shown in FIG. 2, the switching element 8 has a surface 11 which is equipped with a number of touch-sensitive sensors 10. Specifically, five touch-sensitive sensors 10 are arranged linearly next to each other. The individual touch-sensitive sensors 10 are designed as capacitive sensors, which are known as such in the state of the art. They react to contact with the finger 15 of the user of shoe 1.

To close the shoe, the user uses his finger 15 to sweep the touch-sensitive sensors 10 in a first direction R1. If the control means detects said contacting of the sensors 10, it causes a first lacing force level to be reached, i.e. the electric motor 7 is operated with a first, predetermined maximum value for the motor current, e.g. 1.5 A.

Illumination elements 12 in the form of LEDs are arranged on switching element 8. By activating one or more of the illumination elements 12, the user can be informed of the lacing force level.

If the passing of the sensors 10 is repeated with the finger 15 in the first direction R1, a second, higher lacing force level can be approached; a second, preset maximum value for the motor current can now be 2.5 A, for example.

If the sensors 10 are passed again, the lacing force level can be further increased; a third, preset maximum value for the motor current can now be 3.5 A, for example.

The illumination elements 12 can in turn be used to indicate the current lacing force level.

To open the shoe 1, the user sweeps the surface 11, i.e. the touch-sensitive sensors 10, in a second direction R2, opposite to the first direction R1, with his finger 15. The control means 9 then initiate the complete opening of the shoe. The electric motor 7 then moves to the fully relaxed state, which can be determined by a corresponding rotation angle sensor on the tensioning roller 6.

This means that the user does not have to operate a closing or opening switch for a longer period of time—as in the state of the art; it is sufficient to pass over the touch-sensitive sensors 10 in the manner described.

This is an advantage for the user as it allows him to select the appropriate lacing force level for his requirements without having to adjust this by pressing the closing switch for a corresponding length of time.

REFERENCE NUMERALS

1 Shoe
2 Upper part

3 Sole
4 Rotary closure
5 Tensioning element
6 Tensioning roller
7 Electric motor
8 Switching element
9 Control means
10 Touch-sensitive sensor
11 Surface
12 Illumination element (LED)
13 Instep
14 Battery
15 Finger
16 Gearing
R1 First direction
R2 Second direction

The invention claimed is:

1. A shoe, in particular a sports shoe that includes a heel region and a forefoot region, and, comprising:

an upper part having a medial side and a lateral side, and defining a heel cavity, a sole which is connected with the upper part, a rotary closure for fastening the shoe on a wearer's foot by means of at least one tensioning element, wherein the rotary closure comprises a rotatably arranged tensioning roller for winding the tensioning element, wherein the tensioning roller is driven by means of an electric motor, and a switching element which is arranged at the instep and which is connected to control means, wherein the switching element and the control means can actuate the electric motor, wherein the switching element is formed by a number of capacitive sensors which are arranged one beside the other which form a surface which is accessible to a user, wherein the switching element is located at the instep between the forefoot region and the heel region, and between the lateral side and the medial side and entirely forward of the heel cavity of the upper, and wherein the switching element includes a plurality of illumination elements.

2. The shoe according to claim 1, wherein the capacitive sensors are configured to receive a first swipe signal from a user, wherein the first swipe signal is a swipe in a first direction along the capacitive sensors, and wherein the first swipe signal causes the rotary closure to tighten the shoe.

3. The shoe according to claim 2, wherein the capacitive sensors are configured to receive a second swipe signal from the user, wherein the second swipe signal is a swipe in a second direction along the capacitive sensors, different than the first direction, and wherein the second swipe signal causes the rotary closure to loosen the shoe.

4. The shoe according to claim 1, wherein the capacitive sensors are arranged side by side in a linear formation, and wherein between 3 and 7 capacitive sensors are arranged side by side.

5. The shoe according to claim 1, wherein the plurality of illumination elements includes two or more LEDs.

6. The shoe according to claim 5, wherein a greater number of LEDs light up the more the shoe is tightened.

7. The shoe according to claim 1, wherein the switching element and the rotary closure are arranged at different locations of the shoe.

8. The shoe according to claim 7, wherein the rotary closure is arranged in the sole of the shoe.

9. The shoe according to claim 1, wherein a rechargeable battery is arranged in the shoe which is rechargeable inductively and/or contactless.

10. The shoe according to claim 9, wherein a greater number of illumination elements light up the more the shoe is charged.

11. A shoe that includes a heel region and a forefoot region, comprising:

an upper part having a medial side and a lateral side, and defining a heel cavity, a sole which is connected with the upper part, a rotary closure for fastening the shoe on a wearer's foot via tensioning of at least one tensioning element, wherein the rotary closure comprises a rotatably arranged tensioning roller for winding the tensioning element, wherein the tensioning roller is driven by an electric motor, and a switching element which is arranged at the instep, and which is connected to control means, wherein the switching element receives an input that actuates the electric motor, wherein the switching element includes a plurality of capacitive sensors, wherein the switching element is located at the instep between the forefoot region and the heel region, and between the lateral side and the medial side and forward of the entire heel cavity of the upper, and wherein the switching element includes a plurality of illumination elements.

12. The shoe according to claim 11, wherein the capacitive sensors along the switching element are configured to receive a first swipe signal from a user, wherein the first swipe signal is a swipe in a first direction along the capacitive sensors, and wherein the first swipe signal causes the rotary closure to tighten the shoe.

13. The shoe according to claim 12, wherein the capacitive sensors are configured to receive a second swipe signal from the user, wherein the second swipe signal is a swipe in a second direction along the capacitive sensors, different than the first direction, and wherein the second swipe signal causes the rotary closure to loosen the shoe.

14. The shoe according to claim 11, wherein a plurality of LEDs are disposed adjacent the switching element.

15. The shoe according to claim 11, wherein the plurality of illumination elements includes two or more LEDs.

16. The shoe according to claim 15, wherein a greater number of the LEDs light up the more the shoe is tightened.

17. The shoe according to claim 11, wherein the rotary closure is arranged in the sole.

18. The shoe according to claim 11, wherein a rechargeable battery is arranged in the shoe, which is rechargeable inductively.

19. The shoe according to claim 18, wherein a greater number of illumination elements light up the more the shoe is charged.

* * * * *